US012055317B2

(12) United States Patent
Zhou et al.

(10) Patent No.: US 12,055,317 B2
(45) Date of Patent: Aug. 6, 2024

(54) AIR DUCT ASSEMBLY AND INTEGRATED AIR CONDITIONER

(71) Applicants: QINGDAO HAIER AIR CONDITIONER GENERAL CORP., LTD., Shandong (CN); HAIER SMART HOME CO., LTD., Shandong (CN)

(72) Inventors: Shutao Zhou, Qingdao (CN); Wei Guo, Qingdao (CN); Long Zhang, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 351 days.

(21) Appl. No.: 17/607,617

(22) PCT Filed: Mar. 10, 2020

(86) PCT No.: PCT/CN2020/078598

§ 371 (c)(1),
(2) Date: Oct. 29, 2021

(87) PCT Pub. No.: WO2020/220838

PCT Pub. Date: Nov. 5, 2020

(65) Prior Publication Data

US 2022/0214058 A1 Jul. 7, 2022

(30) Foreign Application Priority Data

Apr. 29, 2019 (CN) ..... 201910355402.6

(51) Int. Cl.

| | |
|---|---|
| ***F24F 1/028*** | (2019.01) |
| ***F24F 7/04*** | (2006.01) |
| ***F24F 13/02*** | (2006.01) |

(52) U.S. Cl.
CPC ..... *F24F 7/04* (2013.01); *F24F 1/028* (2019.02); *F24F 13/02* (2013.01)

(58) Field of Classification Search
CPC ..... F24F 7/04; F24F 7/08; F24F 1/028; F24F 13/02; F24F 2007/005; F24F 11/0001; F04D 25/10
See application file for complete search history.

(56) References Cited

U.S. PATENT DOCUMENTS 4,228,786 A * 10/1980 Frankenfield ..... F24F 5/0046 126/400

FOREIGN PATENT DOCUMENTS

| | | |
|---|---|---|
| CN | 101163930 A | 4/2008 |
| CN | 101413706 A | 4/2009 |

(Continued)

OTHER PUBLICATIONS

International Search Report for PCT/CN2020/078598 (ISA/CN) mailed Jun. 5, 2020 with English translation (4 pages).

(Continued)

*Primary Examiner* — Steven S Anderson, II
(74) *Attorney, Agent, or Firm* — Alston & Bird LLP

(57) ABSTRACT

Provided are an air duct assembly and an integrated air conditioner, wherein, the air duct assembly includes a fixed shell and a rotating air duct body, a first air duct and a second air duct are formed in the rotating air duct body having a first position and a second position; when the rotating air duct body is in the first position, the indoor air inlet duct is connected with the indoor air outlet duct, the outdoor air inlet duct is connected with the outdoor air outlet duct, the indoor air inlet duct is disconnected from the outdoor air outlet duct and the outdoor air inlet duct; the indoor air outlet duct is disconnected from the outdoor air outlet duct and the outdoor air inlet duct; when in the second position, the (Continued)

indoor air inlet duct is connected with the first air duct and the outdoor air outlet duct to form a turbid wind exhaust duct, the indoor air outlet duct is connected with the second air duct and the outdoor air inlet duct to form a fresh air inlet duct, the turbid wind exhaust duct is separated from the fresh air inlet duct.

9 Claims, 4 Drawing Sheets

(56) References Cited

FOREIGN PATENT DOCUMENTS

| | | | |
|---|---|---|---|
| CN | 201463152 | U | 5/2010 |
| CN | 106255849 | A | 12/2016 |
| JP | H08121622 | A | 5/1996 |

OTHER PUBLICATIONS

Written Opinion for PCT/CN2020/078598 (ISA/CN) mailed Jun. 5, 2020 with English translation (4 pages).

* cited by examiner

AIR DUCT ASSEMBLY AND INTEGRATED AIR CONDITIONER

CROSS-REFERENCE TO RELATED APPLICATIONS

The present application is a national phase entry of International Application No. PCT/CN2020/078598, filed Mar. 10, 2020, which claims priority to Chinese Patent Application No. 201910355402.6, filed Apr. 29, 2019, which are incorporated herein by reference in their entirety.

FIELD OF THE INVENTION

The present invention belongs to the technical field of air conditioning, and more particularly relates to improvement of construction of an air duct assembly, and an integrated air conditioner with the air duct assembly.

BACKGROUND OF THE INVENTION

The integrated air conditioner is relative to the air-conditioning split machine, an indoor heat exchanger, an outdoor heat exchanger, a compressor, a throttling component, a four-way valve, pipes and all other system components that make up the system are all in an integral housing; an air duct is formed in the housing; an indoor air inlet, an indoor air outlet and an indoor draught fan are arranged at an indoor side, and an outdoor air inlet, the indoor air inlet and an outdoor draught fan are arranged at an outdoor side. A common window air conditioner is a type of integrated air conditioner.

Because of the characteristics of simple structure, convenient installation and space saving (no need to find space to install the outdoor machines), easy moving and low operating noise, and major convenience to life, the integrated air conditioners have been recognized by more and more occasions and people, especially for areas and families with a very small living area per capita.

As we all know, in order to achieve a good cooling and heating effect, and save energy and reduce consumption, when the air conditioner is turned on, the indoor doors and windows are usually closed, however, as users breathe, the indoor oxygen content is getting lower and lower and the carbon dioxide content is getting higher and higher over time, resulting in that the air is not fresh, or even causing suffocating. If the doors and windows are opened at this time, it will cause energy loss and affect the indoor temperature, and when the outdoor air quality is poor, such as smoggy weather, opening the doors and windows will make indoor air quality worse and worse.

In order to solve the above technical problems, an air ventilation recycle system has appeared on the market. The air ventilation recycle system is an effective air purification device that can circulate the indoor air. On one hand, foul indoor air is discharged to the outside, and on the other hand, fresh outdoor air is subjected to sterilization, disinfection, filtration and other measures, and then input into the room to improve the indoor air quality, which can ensure that the air entering the room is clean and healthy, so the air ventilation recycle system is more and more popular among users. However, on the one hand, the use of the air ventilation recycle system to input fresh air into the room will occupy indoor space, and on the other hand, the air ventilation recycle system needs to be purchased separately, which increases the user's use cost. In the prior art, the integrated air conditioner, taking the window air conditioner as an example, does not have an air-conditioning product that can realize both the air conditioning function and the function of the air ventilation recycle system. The existing solution is only to open a small hole (if the diameter is too large, the cooling and heating effect will be influenced and the energy consumption will be increased) on the indoor side of the window air conditioner, so that a small amount of fresh air can enter the room, and the ventilation effect is poor, which cannot be compared with the ventilation effect of a dedicated air ventilation recycle system.

BRIEF DESCRIPTION OF THE INVENTION

The present invention proposes an air duct assembly and an integrated air conditioner for the technical problem that the integrated air conditioner cannot achieve both the air conditioning function and the fresh air exchange function in the prior art.

In order to realize the aim of the present invention, the present invention adopts the following technical scheme:

an air duct assembly, which includes:

a fixed shell, provided with an indoor air inlet duct and an indoor air outlet duct positioned at an indoor side, as well as an outdoor air inlet duct and an outdoor air outlet duct positioned at an outdoor side; the fixed shell is internally provided with an air duct cavity located between the indoor side and the outdoor side, and the indoor air inlet duct, the indoor air outlet duct, the outdoor air inlet duct and the outdoor air outlet duct are all communicated with the air duct cavity;

a rotating air duct body, rotatably disposed in the air duct cavity, a first air duct and a second air duct apart from each other are formed in the rotating air duct body, and the rotating air duct body has a first position and a second position; and when the rotating air duct body is at the first position, the indoor air inlet duct is communicated with the indoor air outlet duct, the outdoor air inlet duct is communicated with the outdoor air outlet duct, the indoor air inlet duct is disconnected from the outdoor air outlet duct and the outdoor air inlet duct, the indoor air outlet duct is disconnected from the outdoor air outlet duct and the outdoor air inlet duct; and when the rotating air duct body is at the second position, the indoor air inlet duct is communicated with the first air duct and the outdoor air outlet duct to form a turbid air exhaust duct, the indoor air outlet duct is communicated with the second air duct and the outdoor air inlet duct to form a fresh air inlet duct, and the turbid air exhaust duct is apart from the fresh air inlet duct.

Further, the rotating air duct body is cylindrical, and includes two coaxially arranged circular end plates, two vertical partitions located between the two circular end plates with two ends correspondingly and fixedly connected to the two circular end plates, and a lateral partition located between the two vertical partitions, two sides of the lateral partition are respectively and fixedly connected to the two vertical partitions to divide an internal space enclosed by the two vertical partitions and the two circular end plates into the first air duct and the second air duct, and both ends of the lateral partition are free ends.

Furthermore, both of the vertical partitions have recesses recessed toward the inside of the rotating air duct body, and the recesses are configured to respectively communicate the indoor air inlet duct and the indoor air outlet duct, and communicate the outdoor air inlet duct and the outdoor air outlet duct when the rotating air duct body is at the first position.

In order to rotate the rotating air duct body smoothly, the air duct cavity is a cylindrical cavity matched with the rotating air duct body, and one end of the air duct cavity penetrates through the fixed shell along an axial direction.

Further, when the rotating air duct body is at the first position, a vertical edge of the vertical partition matches and fits an inner wall of the air duct cavity, edges at two ends of the lateral partition match and fit the inner wall of the air duct cavity; and when the rotating air duct body is at the second position, the vertical edge of the vertical partition matches and fits the inner wall of the air duct cavity, and the edges at the two ends of the lateral partition match and fit the inner wall of the air duct cavity.

In order to reduce the length of an internal airflow path and reduce the airflow resistance, the indoor air outlet duct is arranged opposite to the outdoor air inlet duct, and the indoor air inlet duct is arranged opposite to the outdoor air outlet duct.

The air duct assembly further includes a rotating driving component for driving the rotating air duct body to rotate.

Further, the rotating driving component is a motor, and is fixedly mounted on an outer wall of the shell, one of the circular end plates of the rotating air duct body is correspondingly provided with a central rotating shaft, and the central rotating shaft is connected to an output shaft of the motor.

A limiting structure is disposed on the fixed shell, and is configured to prevent the rotating air duct body from being separated from the fixed shell, so as to make the overall operation reliable.

The present invention also provides an integrated air conditioner, which includes an air duct assembly, and the air duct assembly is the above-mentioned air duct assembly.

Compared with the prior art, the advantages and positive effects of the present invention are:

In the present invention, the rotatable rotating air duct body is arranged in the fixed shell of the air duct assembly. When the rotating air duct body is at the first position, the indoor air inlet duct is communicated with the indoor air outlet duct, and the outdoor air inlet duct is communicated with the outdoor air outlet duct; the indoor air inlet duct is disconnected from the outdoor air outlet duct, and the indoor air inlet duct is disconnected from the outdoor air inlet duct, so that the internal air duct of the air duct assembly is divided into a part close to the indoor side and a part close to the outdoor side, and the two parts do not affect each other, thereby satisfying the realization of the air conditioning function on the integrated air conditioner. When the rotating air duct body is at the second position, the indoor air inlet duct is communicated with the first air duct and the outdoor air outlet duct to form a turbid air exhaust duct; and the indoor air outlet duct is communicated with the second air duct and the outdoor air inlet duct to form a fresh air inlet air duct. The turbid air exhaust duct and the fresh air inlet duct are separated from each other, the two parts of the air ducts do not affect each other, and satisfies the fresh air exchange function on the integrated air conditioner. Thus the present invention makes the internal air duct of the air duct assembly variable through the rotatable rotating air duct body, thereby realizing the switch of the air conditioning function and the fresh air exchange function when being used for the integrated air conditioner, and the air duct with a larger space participates in the exchange of the fresh air when the fresh air exchange function is realized; compared with the existing scheme that only a small hole is arranged on the indoor side of the window air conditioner so that a small amount of fresh air can enter the room, the effect of fresh air exchange is greatly improved.

Other features and advantages of the present invention will become clearer after reading the specific embodiments of the present invention in conjunction with the figures.

BRIEF DESCRIPTION OF THE DRAWINGS

In order to explain the technical scheme in the embodiment of the present invention more clearly, the figures need to be used in the embodiments are briefly described below. Obviously, the figures in the following description are some embodiments of the present invention, for the ordinary technicians in the art, other figures can be obtained according to these figures without creative labor.

DETAILED DESCRIPTION

For the purpose of making the objectives, technical schemes and advantages of the present invention more clear, a further detailed description will be made to the present invention in conjunction with embodiments and figures.

It should be noted that in the description of the present invention, the terms "upper", "lower", "vertical", "lateral", "inner", "outer" and other terms indicating directions or positional relationships are based on the directions or positional relationships shown in the figures, which are only for ease of description, and does not indicate or imply that the device or element must have a specific orientation, or be configured and operated in a specific orientation, therefore cannot be understood as a limitation of the present invention. In addition, the terms "first" and "second" are only used for descriptive purposes, and cannot be understood as indicating or implying relative importance.

Figure 1:
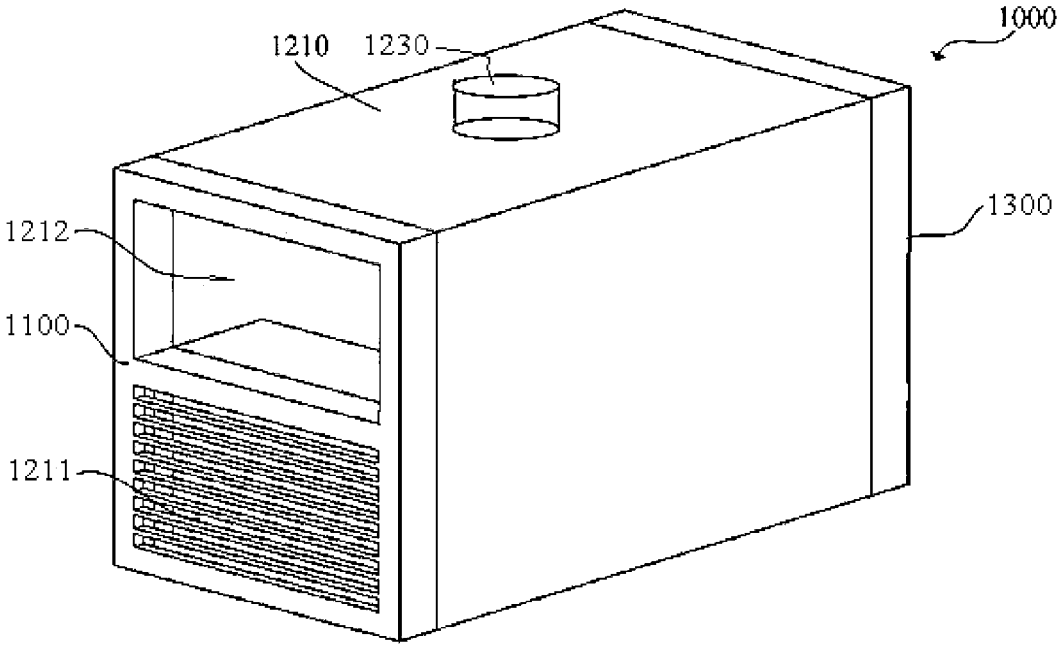
FIG. 1 is a schematic three-dimensional structure diagram of an integrated air conditioner according to an embodiment of the present invention.

Referring to FIG. 1, an exemplary integrated air conditioner 1000 is illustrated. More specifically, the integrated air conditioner 1000 is a window air conditioner. In other embodiments, the integrated air conditioner 1000 may be any other integrated air conditioner, such as a mobile air conditioner, a cabinet type integrated air conditioner, etc.

The integrated air conditioner 1000 mainly includes a cooling and heating system, an air duct assembly 1200, an indoor draught fan, an outdoor draught fan, an indoor side face plate 1100 and an outdoor side face plate 1300.

Figure 2:
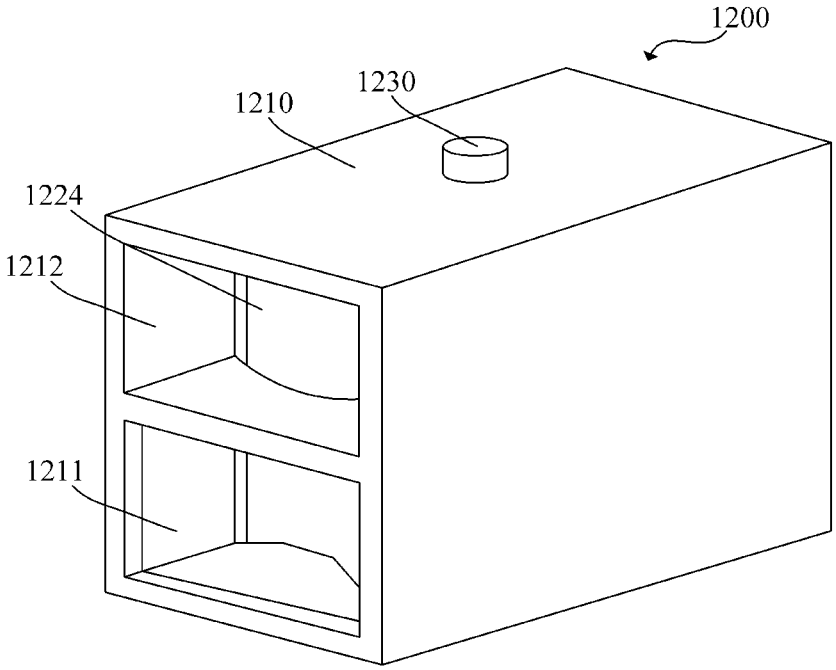
FIG. 2 is a schematic structure diagram of an air duct assembly according to an embodiment of the present invention.
Figure 3:
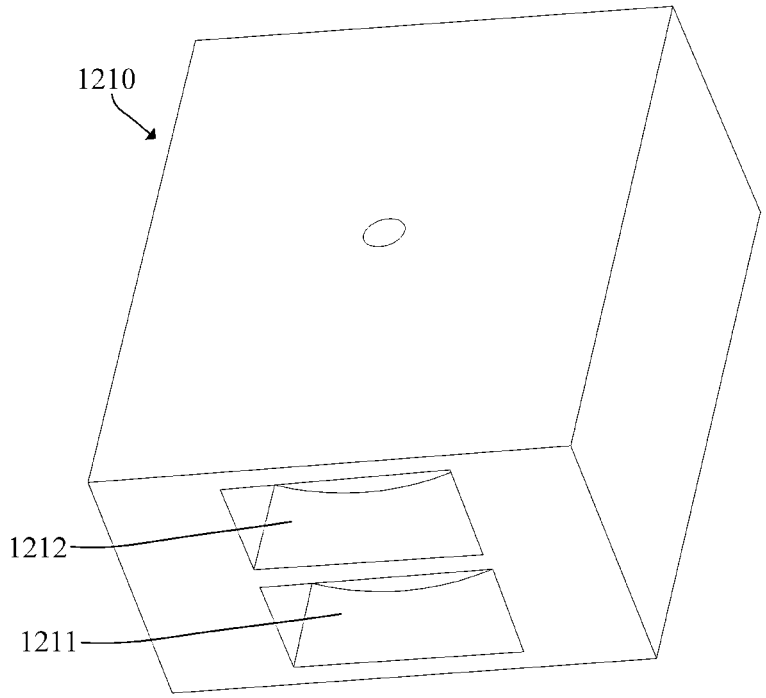
FIG. 3 is a schematic structure diagram of a fixed shell of an air duct assembly according to an embodiment of the present invention.
Figure 4:
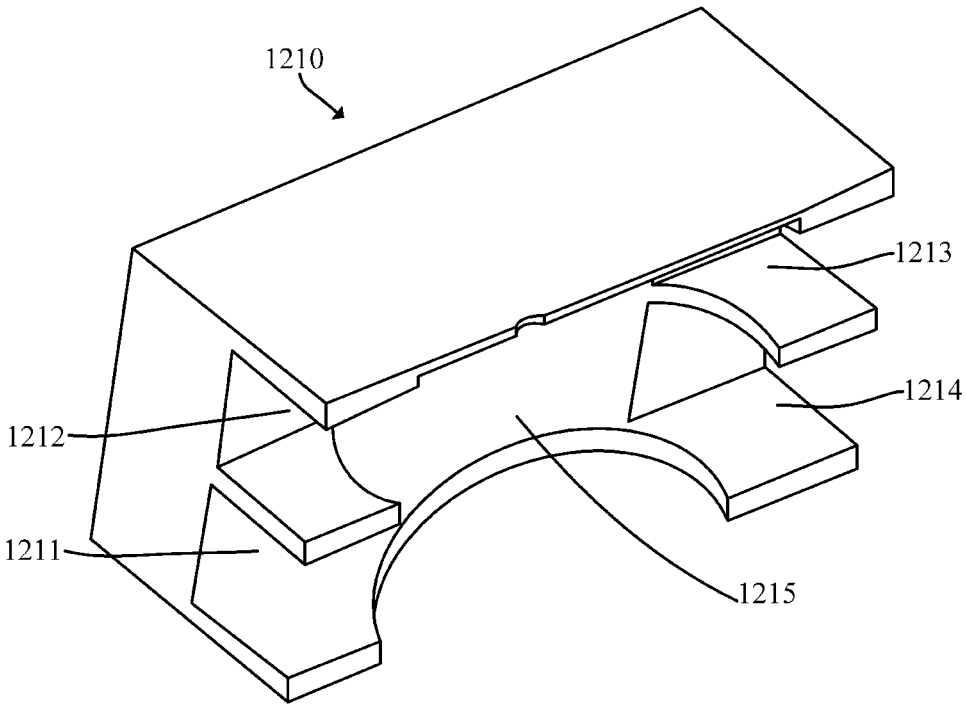
FIG. 4 is a schematic vertical sectional structure diagram of a fixed shell of an air duct assembly according to an embodiment of the present invention.

Specifically, with reference to FIG. 2 to FIG. 4, the air duct assembly 1200 is an internal channel for air flow, and mainly includes a fixed shell 1210. An indoor air inlet duct 1211 and an indoor air outlet duct 1212 positioned at an indoor side, as well as an outdoor air inlet duct 1213 and an outdoor air outlet duct 1214 positioned at an outdoor side are formed in the fixed shell 1210, and the fixed shell 1210 is internally provided with an air duct cavity 1215 which is located between the indoor side and the outdoor side. The indoor air inlet duct 1211, the indoor air outlet duct 1212, the outdoor air inlet duct 1213 and the outdoor air outlet duct 1214 are all communicated with the air duct cavity 1215; the cooling and heating system 1100 is a system assembly of the air conditioner that realizes the cooling or heating function, which includes an indoor heat exchanger, an outdoor heat exchanger, a compressor, a throttling component, a four-way valve, pipes and other system components. The indoor heat exchanger and the indoor draught fan are installed at the indoor air inlet duct 1211, and the outdoor heat exchanger and the outdoor draught fan are installed at the outdoor air inlet duct 1213. The two heat exchangers are connected by the throttling device, the four-way valve, the pipes and the compressor. The cooling and heating principles are the same as the prior art and will not be described in detail, and the structural settings are same as the prior art which is omitted in FIG. 1; the indoor side face plate 1100 is installed on an indoor end of the fixed shell 1210, and air vents corresponding to the indoor air inlet duct 1211 and the indoor air outlet duct 1212 are formed in the indoor side face plate. The outdoor side face plate 1300 is installed on an outdoor end of the fixed shell 1210, and air vents corresponding to the outdoor air inlet duct 1213 and the outdoor air outlet duct 1214 are formed in the outdoor side face plate. The indoor side face plate 1100 and the outdoor side face plate 1300 are used as the main appearance components of the integrated air conditioner 1000, and their structures are also the same as those in the prior art, which will not be repeated. The indoor side face plate 1100, the outdoor side face plate 1300 and the fixed shell 1210 of the air duct assembly 1200 jointly form the outer casing of the integrated air conditioner 1000.

Figure 5:
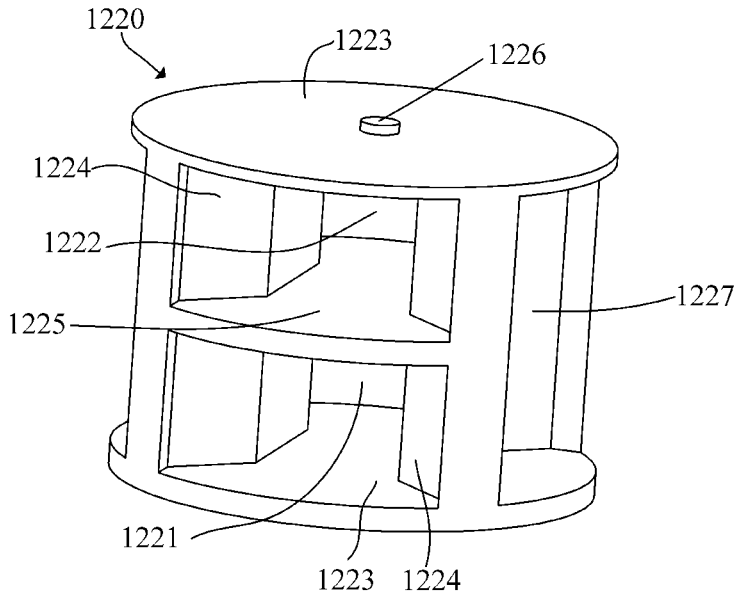
FIG. 5 is a schematic structure diagram of a rotating air duct body of an air duct assembly according to an embodiment of the present invention.
Figure 6:
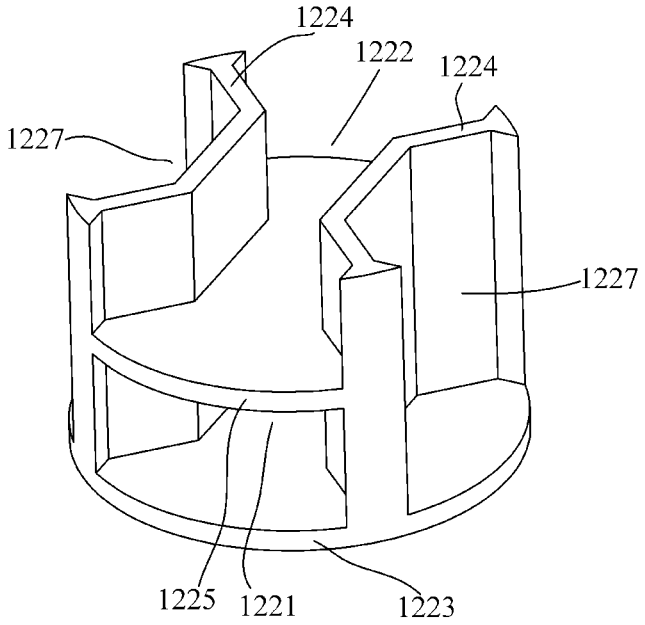
FIG. 6 is a schematic structure diagram of a rotating air duct body with a top circular end plate being eliminated of an air duct assembly according to an embodiment of the present invention.
Figure 7:
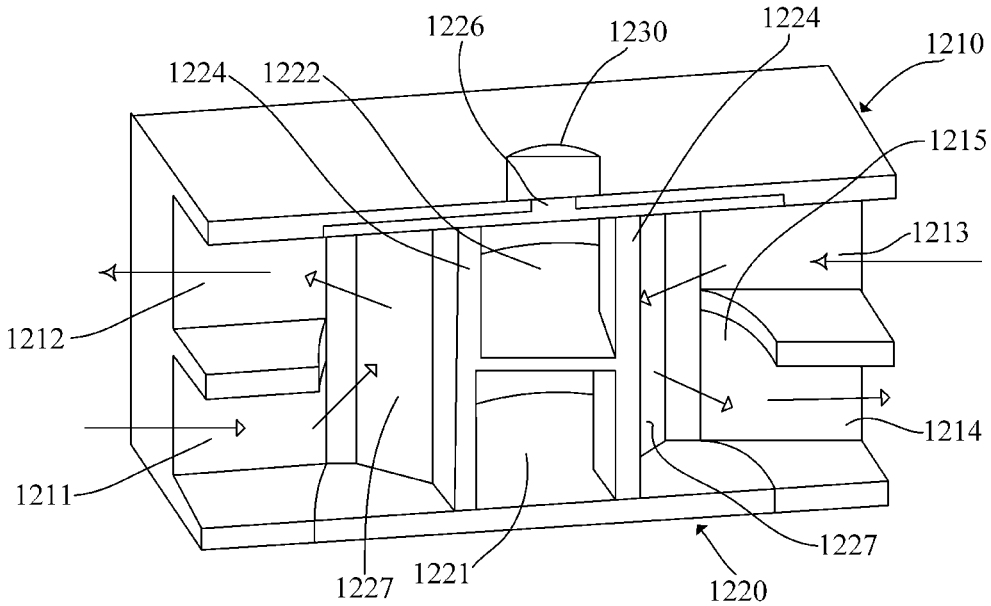
FIG. 7 is a schematic vertical sectional structure diagram when a rotating air duct body of an air duct assembly is at a first position according to an embodiment of the present invention.
Figure 8:
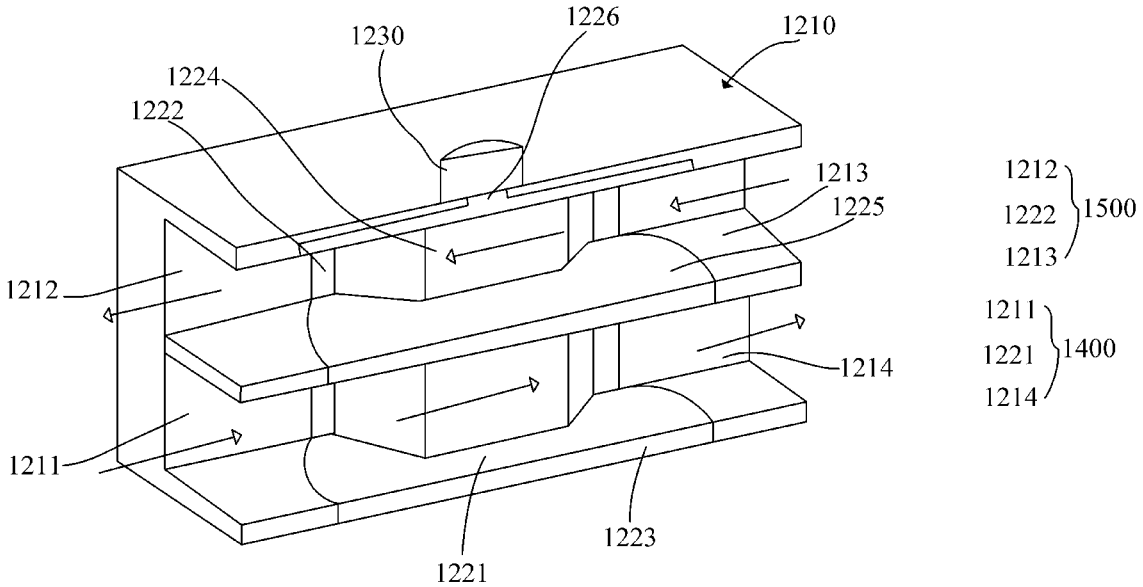
FIG. 8 is a schematic vertical sectional structure diagram when the rotating air duct body of the air duct assembly is at a second position according to an embodiment of the present invention.

Unlike the prior art, referring to FIG. 5 to FIG. 8 and in conjunction with FIG. 2 to FIG. 4, the air duct assembly in the present embodiment also includes a rotating air duct body 1220, so as to realize that the integrated air conditioner 1000 has a fresh air function at the same time, and can be switched with the air conditioning function. Specifically, the rotating air duct body 1220 is rotatably disposed in the air duct cavity 1215, and a first air duct 1221 and a second air duct 1222 apart from each other are formed in the rotating air duct body 1220, and the rotating air duct body 1220 has a first position A and a second position B; meanwhile, when the rotating air duct body 1220 is at the first position A, as shown in FIG. 7, the indoor air inlet duct 1211 is communicated with the indoor air outlet duct 1212, the outdoor air inlet duct 1213 is communicated with the outdoor air outlet duct 1214, the indoor air inlet duct 1211 is disconnected from the outdoor air outlet duct 1214, the indoor air inlet duct 1211 is also disconnected from the outdoor air inlet duct 1213, the indoor air outlet duct 1212 is disconnected from the outdoor air outlet duct 1214, and the indoor air outlet duct 1212 is disconnected from the outdoor air inlet duct 1213, so that the internal air duct of the air duct assembly 1200 is divided into a part close to the indoor side and a part close to the outdoor side by the rotating air duct body 1220. The airflow in the two parts of the air duct does not affect each other, and the airflow direction is shown by the hollow arrow in FIG. 7, so as to satisfy the air conditioning function on the integrated air conditioner. When the rotating air duct body 1220 is at the second position B, as shown in FIG. 8, the indoor air inlet duct 1211 is communicated with the first air duct 1221 and the outdoor air outlet duct 1214 to form a turbid air exhaust duct 1400, the indoor air outlet duct 1212 is communicated with the second air duct 1222 and the outdoor air inlet duct 1213 to form a fresh air inlet duct 1500. The turbid air exhaust duct 1400 is apart from the fresh air inlet duct 1500. The airflow in the two parts of the air duct does not affect each other, and the airflow direction is shown by the hollow arrow in FIG. 8, and satisfies the fresh air exchange function on the integrated air conditioner. When the air conditioning function and the fresh air exchange function are required to switch, only needs to make the rotating air duct body 1220 move to the first position A or the second position B, which is easy to realize, and when the fresh air exchange function is realized, the entire air duct will participate in air exchange. Compared with the existing scheme that only a small hole is formed in the indoor side of the window air conditioner to allow a small amount of fresh air to enter the room, the effect of fresh air exchange is greatly improved.

Further, in the present embodiment, as shown in FIG. 5 and FIG. 6, the rotating air duct body 1220 is cylindrical, and includes two coaxially arranged circular end plates 1223, two vertical partitions 1224 located between the two circular end plates 1223 with two ends correspondingly and fixedly connected to the two circular end plates 1223, and a lateral partition 1225 located between the two vertical partitions 1224, two sides of the lateral partition 1225 are respectively and fixedly connected to the two vertical partitions 1224 to divide an internal space enclosed by the two vertical partitions 1224 and the two circular end plates 1223 into the first air duct 1221 and the second air duct 1222, and both ends of the lateral partition 1225 are free ends, so that when the rotating air duct body 1220 is at the second position B, the indoor air inlet duct 1211 is communicated with the first air duct 1221 and the outdoor air outlet duct 1214 to form the turbid air exhaust duct 1400, and the indoor air outlet duct 1212 is communicated with the second air duct 1222 and the outdoor air inlet duct 1213 to form the fresh air inlet duct 1500.

In order to realize that when the rotating air duct body 1220 is at the first position A, the indoor air inlet duct 1211 is communicated with the indoor air outlet duct 1212, and the outdoor air inlet duct 1213 is communicated with the outdoor air outlet duct 1214, both of the two vertical partitions 1224 have recesses 1227 recessed toward the inside of the rotating air duct body 1220. As shown in FIG. 5 to FIG. 7, when the rotating air duct body 1220 is at the first position A, on one hand, the vertical partition 1224 disconnects the indoor side from the outdoor side, and on the other hand, one of the vertical partitions 1224 is directly facing the indoor side, as shown in FIG. 7, and the recess 1227 of the vertical partition constitutes an intermediate channel communicating the indoor air inlet duct 1211 and the indoor air outlet duct 1212, and the other vertical partition 1224 faces the outdoor side, and the recess 1227 of the vertical partition constitutes an intermediate channel communicating the outdoor air inlet duct 1213 and the outdoor air outlet duct 1214, thereby realizing that when the rotating air duct body 1220 is at the first position A, the indoor air inlet duct 1211 is communicated with the indoor air outlet duct 1212, and the outdoor air inlet duct 1213 is communicated with the outdoor air outlet duct 1214.

In order to rotate the rotating air duct body 1220 smoothly, the air duct cavity 1215 is a cylindrical cavity adapted to the rotating air duct body 1220, and one end of the air duct cavity penetrates through the fixed shell 1210 along an axial direction, so that the rotating air duct body 1220 is easy to be assembled into the air duct cavity 1215.

Further, as shown in FIG. 7 and FIG. 8, since the air duct assembly 1200 of the present embodiment includes at least two independent parts, namely the fixed shell 1210 and the rotating air duct body 1220, in order to make the entire air duct assembly 1200 as compact as possible, and minimize the gap, when the rotating air duct body 1210 is at the first position A, a vertical edge of the vertical partition 1224 matches and fits an inner wall of the air duct cavity 1215, edges at two ends of the lateral partition 1225 match and fit the inner wall of the air duct cavity 1215; and when the rotating air duct body 1210 is at the second position B, the vertical edge of the vertical partition 1224 matches and fits the inner wall of the air duct cavity 1215, and the edges at the two ends of the lateral partition 1225 match and fit the inner wall of the air duct cavity 1215, so as to ensure the airtightness and independence between the two parts of the air duct respectively formed when the rotating air duct body 1210 is at the first position A, and the airtightness and independence between the two parts of the air duct respectively formed when the rotating air duct body is at the second position B, and ensure that they do not affect each other as far as possible.

At the same time, a limiting structure is disposed on the fixed shell 1210 to prevent the rotating air duct body 1220 from being separated from the fixed shell 1210 to make the overall operation reliable. Taking the view shown in FIG. 1 as an example, the limiting structure may be a supporting boss formed at a bottom end of the air duct cavity 1215 on the fixed shell 1210 to support the rotating air duct body 1220, or is a limiting groove formed on the inner wall of the air duct cavity 1215 and a limiting bulge correspondingly provided on the rotating air duct body 1220, the limiting bulge is embedded in the limiting groove, and the two are in sliding cooperation. The present embodiment does not specifically limit the structure of the limiting structure itself.

In order to reduce the length of an internal airflow path and reduce the air resistance, as shown in FIG. 7 and FIG. 8, the indoor air outlet duct 1212 is arranged opposite to the outdoor air inlet duct 1213, and the indoor air inlet duct 1211 is arranged opposite to the outdoor air outlet duct 1214, so that when the fresh air exchange function is realized, the paths of the turbid air exhaust duct 1400 and the fresh air inlet duct 1500 are the shortest as possible, so that the air exhaust and air intake are smooth; in addition, in the present embodiment, the indoor air outlet duct 1211 is located above the indoor air inlet duct 1212, and the outdoor air inlet duct 1213 is located above the outdoor air outlet duct 1214, which cannot be specifically limited in the present embodiment.

The rotation of the rotating air duct body 1220 can be operated manually or electrically. In order to realize the rotation of the rotating air duct body 1220, the air duct assembly 1200 of the present embodiment also includes a rotating driving component 1230 for driving the rotating air duct body 1220 to rotate. The rotating driving component 1230 can be a manual crank or a motor. In the present embodiment, the rotating driving component is preferably a motor to realize electric driving of the rotating air duct body 1220. The motor can be operated by wireless remote control or by directly pressing a switch.

Further, as shown in FIG. 1 and FIG. 6, the rotating driving component 1230 is a motor, which is fixedly mounted on an outer wall of the shell 1210. Specifically, one of the circular end plates 1223 of the rotating air duct body 1220 is provided with a central rotating shaft 1226, as shown in FIG. 5, FIG. 7 and FIG. 8, the end rotating shaft 1226 is located on the circular end plate 1223 at the top of the rotating air duct body 1220, and the central rotating shaft 1226 is connected to an output shaft of the motor 1230, so as to realize that the motor drives the rotating air duct body 1220 to rotate.

The above embodiments are only used to illustrate the technical solutions of the present invention, but not to limit them; although the present invention has been described in detail with reference to the foregoing embodiments, for those of ordinary skill in the art, the technical solutions of the foregoing embodiments can still be modified or some of the technical features can be equivalently replaced; and these modifications or replacements do not cause the essence of the corresponding technical solutions to deviate from the spirit and scope of the technical solutions claimed by the present invention.

The invention claimed is:

1. An air duct assembly, comprising:

a fixed shell, provided with an indoor air inlet duct and an indoor air outlet duct positioned at an indoor side, as well as an outdoor air inlet duct and an outdoor air outlet duct positioned at an outdoor side, wherein the fixed shell is internally provided with an air duct cavity located between the indoor side and the outdoor side, and the indoor air inlet duct, the indoor air outlet duct, the outdoor air inlet duct and the outdoor air outlet duct are all communicated with the air duct cavity;

a rotating air duct body, rotatably disposed in the air duct cavity, wherein a first air duct and a second air duct apart from each other are formed in the rotating air duct body, and the rotating air duct body has a first position and a second position; and when the rotating air duct body is at the first position, the indoor air inlet duct is communicated with the indoor air outlet duct, the outdoor air inlet duct is communicated with the outdoor air outlet duct, the indoor air inlet duct is disconnected from the outdoor air outlet duct and the outdoor air inlet duct, the indoor air outlet duct is disconnected from the outdoor air outlet duct and the outdoor air inlet duct; and when the rotating air duct body is at the second position, the indoor air inlet duct is communicated with the first air duct and the outdoor air outlet duct to form a turbid air exhaust duct, the indoor air outlet duct is communicated with the second air duct and the outdoor air inlet duct to form a fresh air inlet duct, and the turbid air exhaust duct is apart from the fresh air inlet duct, wherein the rotating air duct body is cylindrical, and comprises two coaxially arranged circular end plates, two vertical partitions located between the two circular end plates with two ends correspondingly and fixedly connected to the two circular end plates, and a lateral partition located between the two vertical partitions, two sides of the lateral partition are respectively and fixedly connected to the two vertical partitions to divide an internal space enclosed by the two vertical partitions and the two circular end plates into the first air duct and the second air duct, and both ends of the lateral partition are free ends.

2. The air duct assembly according to claim 1, wherein, both of the vertical partitions have recesses recessed toward the inside of the rotating air duct body, and the recesses are configured to respectively communicate the indoor air inlet duct and the indoor air outlet duct, and communicate the outdoor air inlet duct and the outdoor air outlet duct when the rotating air duct body is at the first position.

3. The air duct assembly according to claim 1, wherein, the air duct cavity is a cylindrical cavity matched with the rotating air duct body, and one end of the air duct cavity penetrates through the fixed shell along an axial direction.

4. The air duct assembly according to claim 3, wherein, when the rotating air duct body is at the first position, a vertical edge of the vertical partition matches and fits an inner wall of the air duct cavity, edges at two ends of the lateral partition match and fit the inner wall of the air duct cavity; and when the rotating air duct body is at the second position, the vertical edge of the vertical partition matches and fits the inner wall of the air duct cavity, and the edges at the two ends of the lateral partition match and fit the inner wall of the air duct cavity.

5. The air duct assembly according to claim 4, wherein, a limiting structure is disposed on the fixed shell, and is configured to prevent the rotating air duct body from being separated from the fixed shell.

6. The air duct assembly according to claim 1, wherein, the indoor air outlet duct is arranged opposite to the outdoor air inlet duct, and the indoor air inlet duct is arranged opposite to the outdoor air outlet duct.

7. The air duct assembly according to claim 4, wherein, the air duct assembly further comprises a rotating driving component for driving the rotating air duct body to rotate.

8. The air duct assembly according to claim 7, wherein, the rotating driving component is a motor, and is fixedly mounted on an outer wall of the shell, one of the circular end plates of the rotating air duct body is correspondingly provided with a central rotating shaft, and the central rotating shaft is connected to an output shaft of the motor.

9. An integrated air conditioner, comprising an air duct assembly, wherein, the air duct assembly is the air duct assembly according to claim 1.

* * * * *